US005244104A

United States Patent [19]

Green et al.

[11] Patent Number: 5,244,104

[45] Date of Patent: Sep. 14, 1993

[54] DRYING RACK AND SPACER

[75] Inventors: Melvin E. Green, Evanston; Claude H. Oltra, Chicago, both of Ill.

[73] Assignee: Sias Equipment Company, Skokie, Ill.

[21] Appl. No.: 816,760

[22] Filed: Jan. 2, 1992

[51] Int. Cl.[5] ..... A47F 5/00

[52] U.S. Cl. ..... 211/150; 34/238; 211/181

[58] Field of Search ..... 211/150, 181; 34/238

[56] References Cited

U.S. PATENT DOCUMENTS

| | | | |
|---|---|---|---|
| 2,563,212 | 8/1951 | Cole | 211/150 |
| 3,103,422 | 9/1963 | Green | 34/238 |
| 3,390,784 | 7/1968 | Fuchs | 34/238 |
| 3,596,770 | 8/1971 | Heinrich | 211/150 |

*Primary Examiner*—Robert W. Gibson, Jr.
*Attorney, Agent, or Firm*—Leydig, Voit & Mayer

[57] ABSTRACT

A drying rack with multiple wire framed shelves with at least one spacer support shaft and a spacer for each wire framed shelf, wherein the spacer comprises (a) a member having a perimeter, preferably a substantially cylindrical member having a substantially circular perimeter, opposing faces, and a central longitudinal axis, (b) a slot extending inwardly or outwardly from the perimeter between the opposing faces along a line substantially parallel to the central longitudinal axis, and (c) a hole extending inwardly from one face, such that the slot is capable of receiving the wire framed shelf and the hole is capable of receiving the spacer support shaft of the wire framed shelf.

32 Claims, 3 Drawing Sheets

DRYING RACK AND SPACER

TECHNICAL FIELD OF THE INVENTION

The present invention relates to multiple shelf drying racks and, more particularly, to an improved drying rack spacer to maintain desired distances between pivotal shelves in a multiple shelf drying rack and the drying rack incorporating such spacers.

BACKGROUND OF THE INVENTION

Drying racks are typically used in the printing arts as a means of inexpensively drying flat materials in a minimum of space. This is particularly the case with the drying of small quantities of materials to avoid the high installation and energy costs associated with the use of gas and electric dryers. For example, drying racks are extensively used in the screen printing business for the drying of small quantity jobs, as well as those jobs which require longer drying times and/or precise color registration attributable to room temperature drying conditions. Moreover, an increasing number of drying racks are being used for drying very large sheets of paper, boards, plastics, circuit boards, glass sheets, metals, woods, hardboards, and the like.

Drying racks have remained substantially unchanged over the years and typically comprise a metal frame chassis which supports up to 50 metal wire shelves or trays. The shelves are formed from crisscrossed metal wires and supported by, and hinged with counterbalancing springs to, a vertical metal frame to allow for pivoting of the shelves between horizontal and inclined positions. Under weight loads, the shelves are maintained in level alignment and prevented from touching one another, particularly on the side of the shelves away from the vertical support frame, by the use of spacers between the shelves. As illustrated in the Advance Process Supply Company's 1982 catalog, the spacers (or bumpers as they are referred to in the catalog) generally comprise 1 inch wide round edge metal bar stock formed into cylindrical shapes and welded to the outside corners of the metal shelves in such a way that they contact the spacers on the adjacent upper and lower shelves to maintain a preset distance between the shelves and ensure that the shelf remains level when loaded with a material to be dried.

U.S. Pat. No. 2,950,541 also describes a drying rack and a spacer therefor, which it terms a corner foot. The corner foot is for use on each shelf of a multiple shelf drying rack having a plurality of pivotal shelves positionable in a horizontal position or in an upwardly inclined position and reportedly allows for the shelves in the inclined position to be spaced a smaller distance apart than the shelves in the horizontal position. The corner foot comprises a generally three-sided stiffly yieldable body member which is relatively thick with respect to the shelf and which has parallel upper and lower surfaces and a generally triangular slot extending from one side thereinto intermediate and substantially parallel to the surfaces for receiving a shelf corner and a leg portion depending from the lower surface of the body and terminating in a bottom surface which is generally parallel to the upper body surface. The leg portion extends along one side of the body member corresponding to the front edge of the shelf, with the width of the leg being substantially narrower than the lower body surface so that the leg is supported on the upper surface of the next lower foot when the shelves are horizontal, and the upper surface of the foot is supported against the lower surface of the next upper corner foot when the shelves are inclined upwardly, with the depending leg of the latter overhanging the forward edge of the former so that the shelves are spaced from each other. The corner foot is made of a stiff, but yieldable material, such as hard rubber, so that it may be forced over the corner edge of the shelf with the shelf frame wire being retained in the enlarged slot portion of the corner foot so that the foot is securely retained on the shelf.

While drying racks and spacers have been utilized for quite a few years, there remains a need for a simple spacer that can be easily applied by the user to a drying rack shelf to maintain any desirable spacing of drying rack shelves, maintain that desirable spacing at any pivotal angle of the drying rack shelves, and provide for additional support for drying rack shelves under the weight of heavier loads, without reducing the shelf area available for supporting the items to be dried on the drying rack shelves.

BRIEF SUMMARY OF THE INVENTION

It is an object of the present invention to provide a drying rack shelf spacer and a drying rack using such spacers which allow the user to easily and quickly attach the spacers to the drying rack.

It is another object of the present invention to provide a drying rack shelf spacer and a drying rack using such spacers which enables a user to attach multiple spacers on each wire framed shelf to provide for additional shelf support when required for heavier shelf loads.

It is a further object of the present invention to provide a drying rack shelf spacer and a drying rack using such spacers which enables a user to easily change the amount of spacing between the wire framed shelves of the drying rack.

It is an additional object of the present invention to provide a drying rack shelf spacer and a drying rack using such spacers which does not reduce the shelf area available for supporting the items to be dried on the drying rack shelves.

It is yet another object of the present invention to provide a drying rack shelf spacer and a drying rack using such spacers which enables the shelves of two or more drying racks to be interconnected to act in concert to thereby extend the drying rack shelf area.

These and other objects and advantages of the present invention, as well as additional inventive features, will be apparent from the description of the invention provided herein.

The present invention includes a spacer for use with a drying rack with multiple wire framed shelves having spacer support shafts, wherein the spacer comprises (a) a member having a perimeter, preferably a substantially cylindrical member having a substantially circular perimeter, opposing faces, and a central longitudinal axis, (b) a slot extending inwardly or outwardly from the perimeter between the opposing faces along a line substantially planar parallel to the central longitudinal axis, and (c) a hole extending inwardly from one face, such that the slot is capable of receiving the wire framed shelf and the hole is capable of receiving the spacer support shaft of the wire framed shelf.

The present invention also includes a drying rack using such shelf spacers which comprises a substantially rectangular base frame, a vertical back frame extending upwardly from one side of the base frame, a plurality of wire framed shelves mounted at spaced vertical intervals on the vertical frame, at least one spacer support shaft on each of the wire framed shelves, and at least one spacer for each of the wire framed shelves for supporting the wire framed shelves in spaced relation, the spacer having a perimeter, preferably being of a substantially cylindrical configuration having a substantially circular perimeter, opposing faces, and a central longitudinal axis, a slot extending inwardly or outwardly from the circular perimeter between the opposing faces along a line substantially planar parallel to the central longitudinal axis, and a hole extending inwardly from one face, such that the slot is capable of receiving the wire framed shelf and the hole is capable of receiving the spacer support shaft of the wire framed shelf.

DETAILED DESCRIPTION OF THE PREFERRED EMBODIMENTS

The present invention concerns a drying rack and shelf spacer for use in a drying rack. The present inventive drying rack and spacer may best be understood with reference to the accompanying drawings wherein illustrative embodiments are shown and in the following detailed description of the preferred embodiments.

Figure 1:
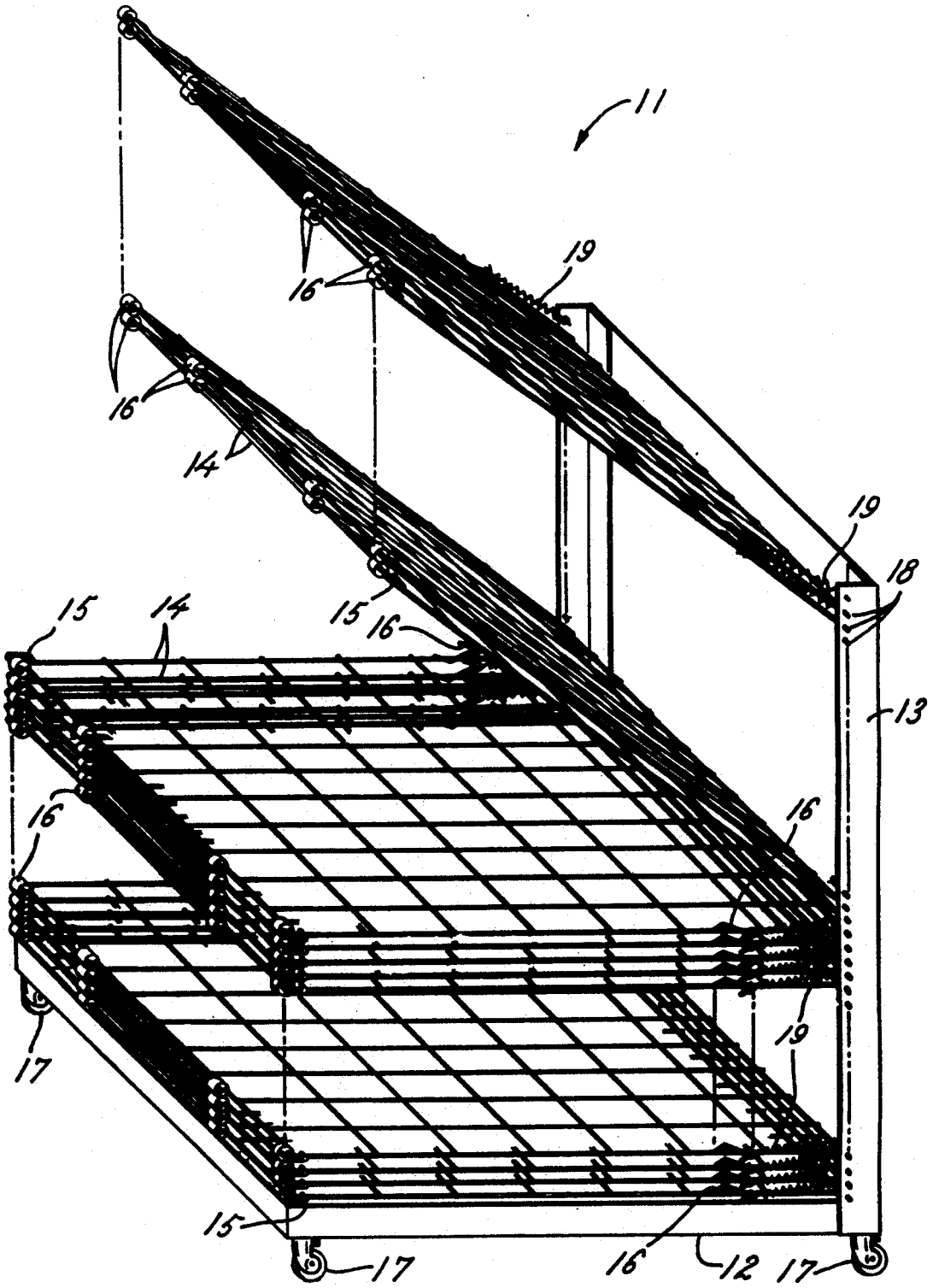
FIG. 1 is a perspective view of a preferred multiple shelf drying rack having spacers in accordance with the present invention.

A preferred multiple shelf drying rack having shelf spacers in accordance with the present invention is depicted in FIG. 1. The drying rack comprises a chassis with a substantially rectangular base frame 12, a vertical back frame 13 which extends upwardly from one side of the base frame 12, a plurality of wire framed shelves 14 mounted at spaced vertical intervals on the vertical frame 13, at least one spacer support shaft 15 on each of the wire framed shelves 14, and at least one spacer 16 for each of the wire framed shelves 14 for supporting the wire framed shelves 14 in spaced relation.

The drying rack 11 may be constructed of any suitable material, preferably of a metal such as steel, aluminum, stainless steel, or magnesium, and may be of any desired size. The drying rack 11 will typically include casters or wheels 17 on its base frame 12 so as to provide easier mobility for the drying rack 11. The wire framed shelves 14 will ordinarily be connected to the vertical frame 13 in such a way so as to allow the shelves to be in either a horizontal position or an inclined upright position to allow access to the wire framed shelves 14. While any suitable connection means may be used, the shelves are most preferably supported by means of pivot shafts 18 or the like which are attached to the shelves 14 and connected to the vertical frame 13. Counterbalancing springs 19 are preferably used to assist the user in raising the wire framed shelves 14 from the horizontal position to the inclined position while also holding the wire framed shelves 14 in the inclined position when they are placed in that position by the user.

The wire framed shelves 14 may be of any suitable material, construction, and size, preferably of a metal wire such as steel, aluminum, stainless steel, or magnesium. Other wire materials and a variety of diameters may of course be used, and shelves of thicker diameter will be capable of supporting larger and heavier loads. The use of pivot shafts 18 and springs 19 as described above will enable a user to easily manipulate small and large shelves.

Figure 2:
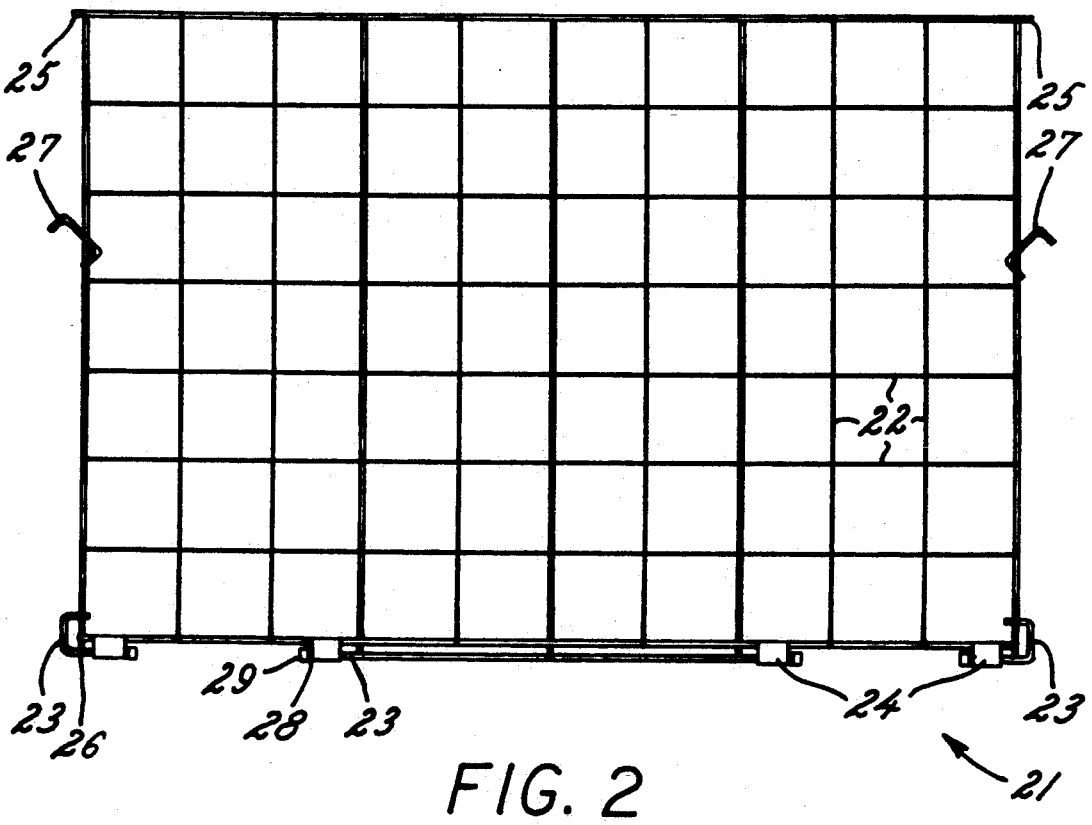
FIG. 2 is an enlarged perspective view of a preferred metal framed shelf of a drying rack using spacers in accordance with the present invention.
Figure 3:
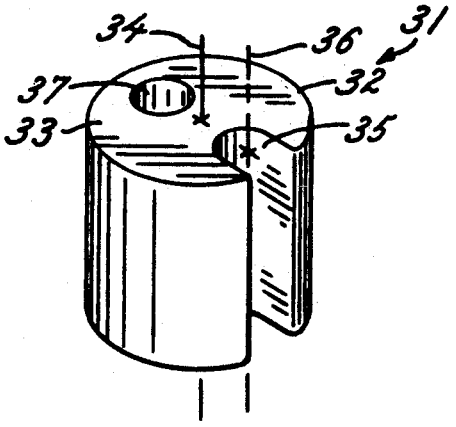
FIG. 3 is a perspective view of a preferred spacer of the present invention.
Figure 4:
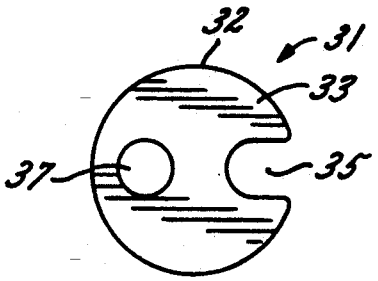
FIG. 4 is a top planar view of the preferred spacer of the present invention depicted in FIG. 3.

As shown in FIG. 2, the wire framed shelf 21 of the present inventive drying rack is formed of crisscrossed wires 22 which may be the same or of differing materials and diameters. The wire framed shelf 21 is preferably constructed of plated steel wire of 5/16 inch diameter around the perimeter and of ⅛ inch diameter crisscrossed wires in the interior of the shelf.

The wire framed shelf 21 includes at least one spacer support shaft 23, preferably at least two spacer support shafts 23, for use in conjunction with the present inventive spacers 24. If only a single spacer support shaft 23 is used, it should be positioned in the center along the front side of the wire framed shelf 21 opposite the vertical frame 13 so as to enable maintenance of the spaced relation of the wire framed shelves 21 with the spacer 24; otherwise, one corner of the wire framed shelf may not be kept level, particularly with larger shelves and/or heavier loads. The use of at least two spacer support shafts 23 allows for the use of at least two spacers 24 with each wire framed shelf 21 to further ensure that the wire framed shelves of the present inventive drying rack are maintained in the desired spaced relation. When at least two spacer support shafts 23 are used with each wire framed shelf 21, a spacer support shaft 23 is positioned substantially in each of the two opposite corner of the wire framed shelf 21 farthest away from the vertical frame 13. Larger drying racks preferably utilize a wire framed shelf 21 having three, and most preferably four, spacer support shafts 23 along the edge of the wire framed shelf 21 opposite the vertical frame 13, with two spacer support shafts 23 in the opposite corners as described above and two spacer support shafts 23 spaced in the center.

The spacer support shafts 23 will typically be in the same place on each wire framed shelf 21 so that the spacers 24 thereon will be in a uniform touching alignment relationship with spacers 24 on adjacent upper and lower wire framed shelves 21 to maintain the proper spaced relationship of the wire framed shelves 21. The spacer support shafts 23 are preferably located outside the perimeter of the wire framed shelf 21, most preferably on the front of the wire framed shelf 21 along the edge of the wire framed shelf 21 opposite the vertical frame 13, such that the spacers 24 do not reduce the surface area of the wire framed shelf 21 available for drying an object.

While the spacer support shafts 23 may be of any suitable material and configuration suitable for mating with the spacers 24, the spacer support shafts 23 preferably comprises wire of the same material and diameter as the wire of the wire framed shelf 21, particularly the wire along the perimeter of the wire framed shelf 21, and most particularly the wire of the perimeter of the wire framed shelf 21 which will be received into the spacer 24. The spacer support shafts 23 may be oriented in any suitable manner but are preferably positioned such that the longitudinal axis of the spacer 24 is maintained in a substantially planar parallel relationship with the wire framed shelf 21, most preferably the pivot shaft 25 which is a part of the wire framed shelf 21 and is the means whereby the wire framed shelf 21 is connected to the drying rack through the vertical frame. The preferred alignment is most easily accomplished by utilizing a spacer support shaft 23 comprising a wire member 26 to be inserted into the spacer 24 with the wire member 26 being oriented substantially planar parallel with the wire framed shelf 21, particularly the pivot shaft 25 thereof.

When springs 18 are used in the drying rack, the wire framed shelf 21 will also typically contain a spring hook 27. The spring hook 27 may be of any suitable material and configuration and is preferably constructed of the same wire material and diameter as the remainder of wire framed shelf 21.

In order to prevent side-to-side slippage or the accidental dislodgement of the spacer 24 from a wire framed shelf 21, the spacer support shaft 23 is preferably designed such that it extends through the spacer 24 with the end 28 of the spacer support shaft 23 being altered or capped to prevent side movement of the spacer 24. A conventional metal retaining ring 29 is preferably used for this purpose since such a retaining ring can be removed and is so inexpensive that its destruction upon removal is of no consequence.

As shown in FIGS. 3–6 which depict two preferred spacers of the present invention, the present inventive spacers 31 and 51 are preferably of a substantially cylindrical configuration having a substantially circular perimeter 32 and 52, opposing faces (one opposing face of which is shown at 33 and 53), and a central longitudinal axis 34 and 54, a slot 35 and 55 extending from the circular perimeter 32 and 52 between the opposing faces along a line 36 and 56 substantially parallel to the central longitudinal axis 34 and 54, and a spacer locating and support hole 37 and 57 extending inwardly from one face 33 and 53, such that the slot 35 and 55 is capable of receiving the wire framed shelf 21, particularly the perimeter wire thereof, and the hole 37 and 57 is capable of receiving the spacer support shaft 23 of the wire framed shelf 21.

While the spacer is preferably of a substantially cylindrical configuration having a substantially circular perimeter, the spacer may be of other configurations, particularly configurations that provide for uniform spacing of the wire framed shelves in the horizontal position and for uniform spacing of the wire framed shelves in the upward inclined position, with the shelf spacing in the horizontal and upward inclined positions being the same or different. For example, the two-step spacer or corner foot of U.S. Pat. No. 2,950,541, the disclosure of which is hereby incorporated by reference, could be adapted for use as a spacer in the context of the present invention.

The spacer 31 and 51 may be made of any suitable material such as a metal, plastic, or rubber, preferably a metal such as aluminum, steel, stainless steel, or magnesium, and most preferably aluminum for lowest cost and ease of handling. The spacer 31 and 51 may be prepared in any suitable manner such as by conventional extrusion, casting, or forming techniques, preferably through extrusion means.

While the spacer hole 37 and 57 may be positioned in any suitable place on said opposing face 33 and 53 such that it mates with the spacer support shaft 23 of the wire framed shelf 21, the spacer hole 37 and 57 is preferably positioned substantially on or near said central longitudinal axis 34 and 54 of the spacer 31 and 51. The spacer hole 37 and 57 need not extend through to the other opposing face but preferably does so extend from one opposing face 33 and 53 to the other opposing face (not shown) of the spacer 31 and 51. As explained above, the extension of the spacer support shaft 23 through the spacer 31 and 51 to the other opposing face allows for the use of a means to prevent the shifting and unintentional or accidental removal of the spacer 31 and 51 from the spacer support shaft 23 of the wire framed shelf 21.

The spacer slot 35 and 55 may be of any suitable configuration to mate with the wire framed shelf 21. The spacer slot 35 and 55 is preferably of a U-shaped configuration having approximately the same opening width as, most preferably a slightly larger opening width than, the diameter of the wire of the wire framed shelf 21 which is received by the spacer slot 35 and 55. While the spacer slot 35 and 55 preferably extends inwardly from the circular perimeter 32 and 52 of the spacer 31 and 51 (as shown in FIGS. 3–6), the spacer slot 35 and 55 may also extend outwardly of the circular perimeter 31 and 51 (see FIG. 8).

Both the spacer support shaft 23 and the spacer hole 37 and 57 are of a suitable configuration to allow for the mating of the spacer 31 and 51 on the spacer support shaft 23. The spacer support shaft 23 and the spacer hole 37 and 57 are preferably of a substantially cylindrical configuration and preferably have approximately the same diameter. The spacer support shaft 23 and the spacer hole 37 and 57 are also preferably of a configuration providing for a snug fit of the spacer 31 and 51 on the spacer support shaft 23 of the wire framed shelf 21.

Figure 5:
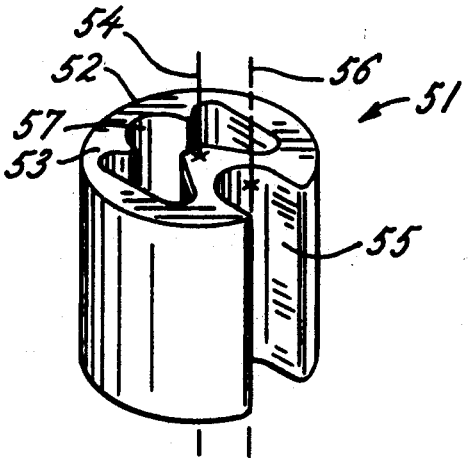
FIG. 5 is a perspective view of another preferred spacer of the present invention.
Figure 6:
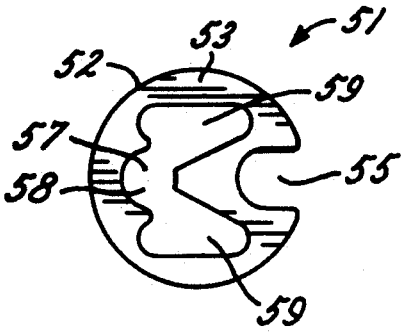
FIG. 6 is a top planar view of the preferred spacer of the present invention depicted in FIG. 5.

Two alternative spacer holes 37 and 57 are depicted in FIGS. 3–4 and 5–6, respectively. While the spacer 31 has a spacer hole 37 which is solely of a substantially cylindrical configuration, the spacer 51 has a spacer hole 57 which is of a configuration providing for an open cylindrical portion 58 on the central longitudinal axis 54 and additional portions 59. The spacer 51 of FIGS. 5–6 is preferred inasmuch as it provides a snug fit with the spacer support shaft 23 of the wire framed shelf 21 while minimizing the amount of material required to manufacture the spacer 51.

A snug fit of the spacer slot 35 and 55 on the wire framed shelf 21 is not critical if there is a snug fit of the spacer 31 and 51 around the spacer support shaft 23 inserted in the spacer hole 37 and 57 on or near the central longitudinal axis 34 and 54. In such a situation, any movement of the spacer 31 and 51 will largely involve rotational movement about its central longitudinal axis 34 and 54 which will not affect the spacing between the wire framed shelves 21 since the spacer 31 and 51 is substantially cylindrical. If the space support shaft 23 and spacer hole 37 and 57 are such that there is not a snug fit, then the spacer slot 35 and 55 is preferably designed to minimize any movement of the spacer 31 and 51 by, for example, providing for a snug fit between the spacer slot 35 and 55 and the wire framed shelf 21.

When 5/16 inch wire is used to construct the wire framed shelf 21, the spacer slot 35 and 55 is preferably 11/32 inch wide to allow for easy assembly and mating of the spacer 31 and 51 and wire framed shelf 21, while the spacer hole 37 and 57 is preferably 5/16 inch diameter or slightly larger to provide for a snug fit with the spacer support shaft 23 of the wire framed shelf 21. The spacer 31 and 51 may be of any suitable shelf supporting length, preferably about 1 inch or so. The spacer 31 and 51 may be of any suitable diameter to provide for the desired spacing between the wire framed shelves in the drying rack 11. For example, in a drying rack having 50 shelves, typical spacing between shelves will be about $\frac{5}{8}$ inch which can be provided with a spacer of about $1\frac{1}{8}$ inch diameter in a drying rack where the central longitudinal axis 34 and 54 of the spacer 31 and 51 is planar parallel with the wire framed shelf 21. Defective spacers are readily replaceable by a user, and by replacing the spacers on a wire framed shelf with spacers of a different diameter (preferably in conjunction with changing the pivot points at which the shelf is connected to the vertical frame and/or removing some of the shelves), the user may easily change the spacing between all or some of the shelves. With drying racks containing shelves with additional spacer support shafts, a user can also add additional spacers to ensure that the wire framed shelves remain properly spaced and level even under heavy loads.

The spacers of the present invention may also be designed such that it is possible to connect the spacers with a rigid support. The ability to connect the spacers is particularly useful in connecting two or more drying racks side-by-side so that corresponding shelves act in concert to increase the individual shelf size for the drying of large objects such as long banners and the like.

Figure 7:
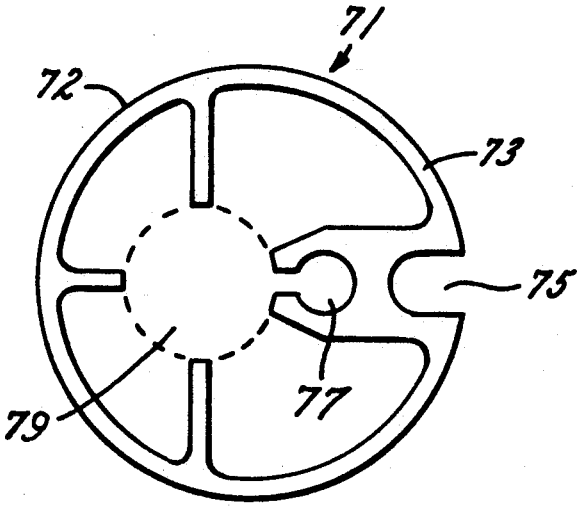
FIG. 7 is a top planar view of a preferred spacer of the present invention which enables the connection of multiple drying racks.
Figure 8:
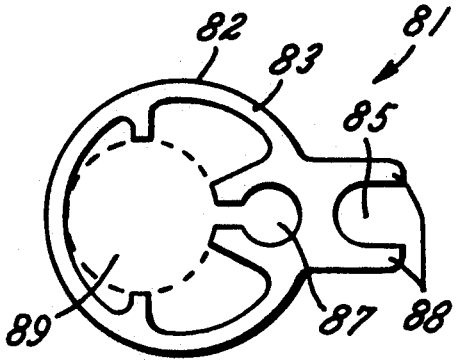
FIG. 8 is a top planar view of another preferred spacer of the present invention which enables the connection of multiple drying racks.

As depicted in FIGS. 7 and 8, such spacers 71 and 81 are of a substantially cylindrical configuration having a substantially circular perimeter 72 and 82, opposing faces (one of which is shown at 73 and 83), and a central longitudinal axis (not shown). The spacers 71 and 81 also have a slot 75 and 85 extending from the circular perimeter 72 and 82 between the opposing faces along a line substantially planar parallel to the central longitudinal axis. The spacer slot 75 may extend inwardly from the circular perimeter 72, or the spacer slot 85 may extend outwardly from the circular perimeter 82 by way of two extending members 88. The spacers 71 and 81 further contain a hole extending inwardly from one face 73 and 83 of the spacer 71 and 81. The holes 77 and 87 of spacers 71 and 81 are of an open cylindrical design. The above comments about the spacers depicted in FIGS. 3–6 are also generally applicable to the spacers of FIGS. 7–8.

The spacers 71 and 81 also contain an additional support hole 79 and 89 extending inwardly from one of the opposing faces 73 and 83 of the spacer 71 and 81, and preferably extending through the spacer 71 and 81 to the other of the opposing faces (not shown). The support hole 79 and 89 allows for the positioning of a rigid support between spacers, particularly spacers on corresponding shelves of adjacent drying racks to enable two or more shelves to act in concert on adjacent drying rack shelves and thereby effectively increase the size of individual shelves. For that purpose, the support hole 79 and 89 is preferably of a configuration such that mating with the rigid support provides for a snug fit between the spacer 71 and 81 and the rigid support. The rigid support may be of any suitable material, such as metal, plastic, or wood, and may be of any suitable configuration, preferably a rigid horizontal support tube of approximately $\frac{3}{4}$ inch diameter. The support hole is preferably of a substantially cylindrical configuration of a slightly larger diameter than the diameter of round tube to be used as the rigid support. Most preferably, the cylindrical support hole 79 and 89 is of a configuration including an open cylindrical portion defined by extending members 74 and 84 with additional areas within the spacer 71 and 81 having been removed to reduce the overall amount of material, and corresponding cost, of the spacer. Most preferably, the cylindrical support hole 79 and 89 is interconnected to the spacer hole 77 and 87 for ease of manufacture and to further reduce the overall amount of material, and corresponding cost, of the spacer.

While the present invention has been described with an emphasis upon preferred embodiments, it will be obvious to those of ordinary skill in the art that variations in the preferred drying rack and spacer may be employed and that it is intended that the present invention may be practiced otherwise than as specifically described herein. Accordingly, this invention includes all modifications encompassed within the spirit and scope of the following claims.

What is claimed is:

1. A drying rack comprising a substantially rectangular base frame, a vertical back frame extending upwardly from one side of said base frame, a plurality of wire framed shelves mounted at spaced vertical intervals on said vertical frame, at least one spacer support shaft on each of said wire framed shelves, and at least one spacer for each of said wire framed shelves for supporting said wire framed shelves in spaced relation, said spacer having a perimeter, opposing faces, and a central longitudinal axis, a slot extending inwardly or outwardly from said perimeter between said opposing faces along a line substantially planar parallel to said central longitudinal axis, and a hole extending inwardly from one face, such that said slot is capable of receiving said wire framed shelf and said hole is capable of receiving said spacer support shaft of said wire framed shelf.

2. The drying rack of claim 1, wherein said wire framed shelves are connected to said vertical frame such that said wire framed shelves can pivot between horizontal and upward inclined positions.

3. The drying rack of claim 2, wherein said spacer is of a configuration providing for uniform spacing of the wire framed shelves in the horizontal position and for uniform spacing of the wire framed shelves in the upward inclined position.

4. The drying rack of claim 3, wherein said spacer is of a substantially cylindrical configuration having a substantially circular perimeter.

5. The drying rack of claim 4, wherein said spacer hole is substantially planar parallel to said central longitudinal axis of said spacer.

6. The drying rack of claim 5, wherein said spacer hole extends from one opposing face to the other opposing face of said spacer.

7. The drying rack of claim 6, wherein said spacer slot is a U-shaped slot.

8. The drying rack of claim 7, wherein said spacer slot has approximately the same opening width as the diameter of the wire of said wire framed shelves which is received by said spacer slot.

9. The drying rack of claim 8, wherein said spacer slot extends inwardly from said circular perimeter.

10. The drying rack of claim 9 wherein said spacer support shaft and said spacer hole are of a substantially cylindrical configuration.

11. The drying rack of claim 10, wherein said spacer support shaft and said space hole have approximately the same diameter.

12. The drying rack of claim 9, wherein said spacer hole is of a configuration providing for a snug fit on said spacer support shaft.

13. The drying rack of claim 12, wherein said spacer support shaft extends through said spacer hole and the end of said spacer support shaft is capped to prevent unintentional removal of said spacer from said wire framed shelves.

14. The drying rack of claim 12, wherein said wire framed shelves contain at least two spacer support shafts which are positioned substantially in opposite corners of said wire framed shelves farthest away from said vertical back frame.

15. The drying rack of claim 13, wherein said wire framed shelves contain four spacer support shafts along the edge of each of said wire framed shelves opposite said vertical back frame.

16. The drying rack of claim 12, wherein said spacer support shaft comprises wire of the same diameter as the wire of said wire framed shelves.

17. The drying rack of claim 16, wherein said spacer support shaft is positioned such that said central longitudinal axis of said spacer is maintained in a substantially planar parallel relationship with said wire framed shelves.

18. The drying rack of claim 17, wherein said spacer support shaft comprises a wire member extending into said spacer hole, said wire member being substantially planar parallel with said wire framed shelves.

19. The drying rack of claim 8, wherein said spacer contains a support hole extending inwardly from one face of said spacer such that said spacer support hole is capable of receiving a rigid support.

20. The drying rack of claim 19, wherein said spacer support hole extends from one opposing face to the other opposing face of said spacer.

21. The drying rack of claim 20, wherein said spacer support shaft, said spacer hole, and said spacer support holes are of a substantially cylindrical configuration.

22. A spacer for use on a drying rack with multiple wire framed shelves having spacer support shafts comprising:

(a) a member having a perimeter, opposing faces, and a central longitudinal axis, (b) a slot extending inwardly or outwardly from said perimeter between said opposing faces along a line substantially planar parallel to said central longitudinal axis, and (c) a hole extending inwardly from one face, such that said slot is capable of receiving said wire framed shelf and said hole is capable of receiving said spacer support shaft of said wire framed shelf.

23. The spacer of claim 22, wherein said spacer is of a substantially cylindrical configuration having a substantially circular perimeter.

24. The spacer of claim 23, wherein said spacer hole is substantially planar parallel to said central longitudinal axis of said spacer 25. The spacer of claim 24, wherein said spacer hole extends from one opposing face to the other opposing face of said spacer.

26. The spacer of claim 25, wherein said spacer slot is a U-shaped slot.

27. The spacer of claim 26, wherein said spacer slot extends inwardly from said circular perimeter.

28. The spacer of claim 27, wherein said spacer hole is of a substantially cylindrical configuration.

29. The spacer of claim 28, wherein said spacer hole is of an open cylindrical design.

30. The spacer of claim 26, wherein said spacer contains a support hole extending inwardly from one face of said spacer such that said spacer support hole is capable of receiving a rigid support.

31. The spacer of claim 30, wherein said spacer support hole extends from one opposing face to the other opposing face of said spacer.

32. The spacer of claim 31, wherein said spacer hole and said spacer support hole are connected.

* * * * *